United States Patent [19]

Mitlin et al.

[11] Patent Number: 4,934,677

[45] Date of Patent: Jun. 19, 1990

[54] HOLDER FOR ELECTRONIC DEVICES

[75] Inventors: Timothy W. Mitlin, Midland; James C. Sell, Jr., Saginaw, both of Mich.

[73] Assignee: Dow Corning Corporation, Midland, Mich.

[21] Appl. No.: 398,354

[22] Filed: Aug. 24, 1989

[51] Int. Cl.[5] ..... B25B 1/04

[52] U.S. Cl. ..... 269/254 CS; 269/270; 269/903

[58] Field of Search ..... 269/157, 160, 269, 270, 269/903, 254 CS; 29/747, 748, 749, 760

[56] References Cited

U.S. PATENT DOCUMENTS

| | | | |
|---|---|---|---|
| 488,058 | 12/1892 | Breed | 269/254 CS |
| 3,941,363 | 3/1976 | Ogg | 269/254 CS |
| 4,519,129 | 5/1985 | Caveney et al. | 269/270 |
| 4,576,114 | 3/1986 | Kaplan et al. . | |
| 4,636,126 | 1/1987 | Spotts . | |
| 4,654,227 | 3/1987 | Cornellier . | |
| 4,837,926 | 6/1989 | Boutcher | 269/903 |

*Primary Examiner*—Robert C. Watson

*Attorney, Agent, or Firm*—Robert Spector

[57] ABSTRACT

A work piece holder for dual-in-line packages and other electronic devices comprises a base on which is mounted a fixed jaw and a movable jaw having opposing vertical surfaces that are substantially parallel to one another. At least a portion of the area encompassed by these two jaw surfaces constitutes a grasping area for immobilizing at least one DIP or similar electronic device located on the upper surface of the fixed jaw. The movable jaw is urged into contact with the fixed jaw by at least one spring or other resilient means associated with the movable jaw. The holder is equipped with a means for releasing the secured device(s) from the holder, which comprises means for exerting a force on the movable jaw in a direction substantially opposite to the force acting on the movable jaw.

6 Claims, 3 Drawing Sheets

HOLDER FOR ELECTRONIC DEVICES

BACKGROUND OF THE INVENTION

1. Field of the Invention

This invention relates to a work piece holder, and more particularly to a holder for securing electronic devices such as integrated circuits, switches and connectors in a fixed position during processing or inspection of the device. The holder is particularly suitable for dual in-line packages (DIP's) that are widely used in the electronic industry for encapsulating semiconductors, integrated circuits, miniature switches and connectors.

2. Description of Background Art

DIP's typically consist of a substantially rectangular body in which at least a portion of the electronic device or connector is imbedded. A DIP has two substantially parallel rows of electrical connectors projecting from one surface of the device.

The operations involved in manufacture of these devices typically include mechanical manipulation and/or coating of selected portions of the device. Switches, potentiometers and other devices have parts requiring mechanical manipulation, typically a rocker arm or a shaft, that projects through the surface of the encapsulating material. The resulting gap in the encapsulating material allows for the entry of moisture or other materials that could interfere with proper operation of the device within the package.

Many DIP's are relatively small, typically less than five centimeters in length by about one centimeter wide. It is difficult to secure these devices in a manner that permits a continuous, automated processing or inspection operation without blocking a portion of the area involved in the operation.

U.S. Pat. No. 4,654,227, which issued to Cornillier on Mar. 31, 1987 describes an apparatus for applying solder to the leads of dual in-line packages. The packages are transported from one location to another by means of sets of fingers attached to a closed loop type of conveyer that includes means for varying the distance between the two fingers in each set, thereby enabling them to grasp and release the package at the various work stations associated with the lead tinning process.

Present methods for processing DIP's involve placing a plurality of these devices in an inclined channel adjacent to a work station and controlling the movement of devices out of the channel into the work area by means of pins or other devices that at least partially block the channel.

SUMMARY OF THE INVENTION

One objective of this invention is to provide a holder for accurately positioning and immobilizing at least one dual-in-line package (DIP) or similar electronic device during a processing or inspection operation, while maximizing the exposed surface area of the package. A preferred embodiment of the holder allows for the precise alignment of devices required for automated treating processes.

Briefly described, the holder of the present invention comprises (1) a base having a substantially planar surface, (2) a fixed jaw secured to said surface, (3) a movable jaw positioned on said surface and having a first substantially planar vertical surface that faces and is parallel to a second vertical surface located on said fixed jaw, (4) a grasping area defined by a portion of said first and second vertical surfaces, whereby at least one dual-in-line package or similar electronic device positioned on a substantially horizontal surface adjoining the vertical surface of said fixed jaw is immobilized, (5) resilient means associated with said movable jaw for urging said movable jaw into contact with the vertical surface of said fixed jaw with sufficient force to immobilize said device within the grasping area, and (6) means for allowing removal of devices from said grasping area, comprising means for exerting s force on the movable jaw in a direction substantially opposite to the force urging the movable jaw toward the fixed jaw, thereby increasing the distance between the fixed and movable jaws sufficiently to remove the immobilizing force acting on said device.

A preferred embodiment of the present holder includes means for aligning at least one DIP at predetermined locations within the grasping area.

DESCRIPTION OF THE PREFERRED EMBODIMENTS

Figure 1:
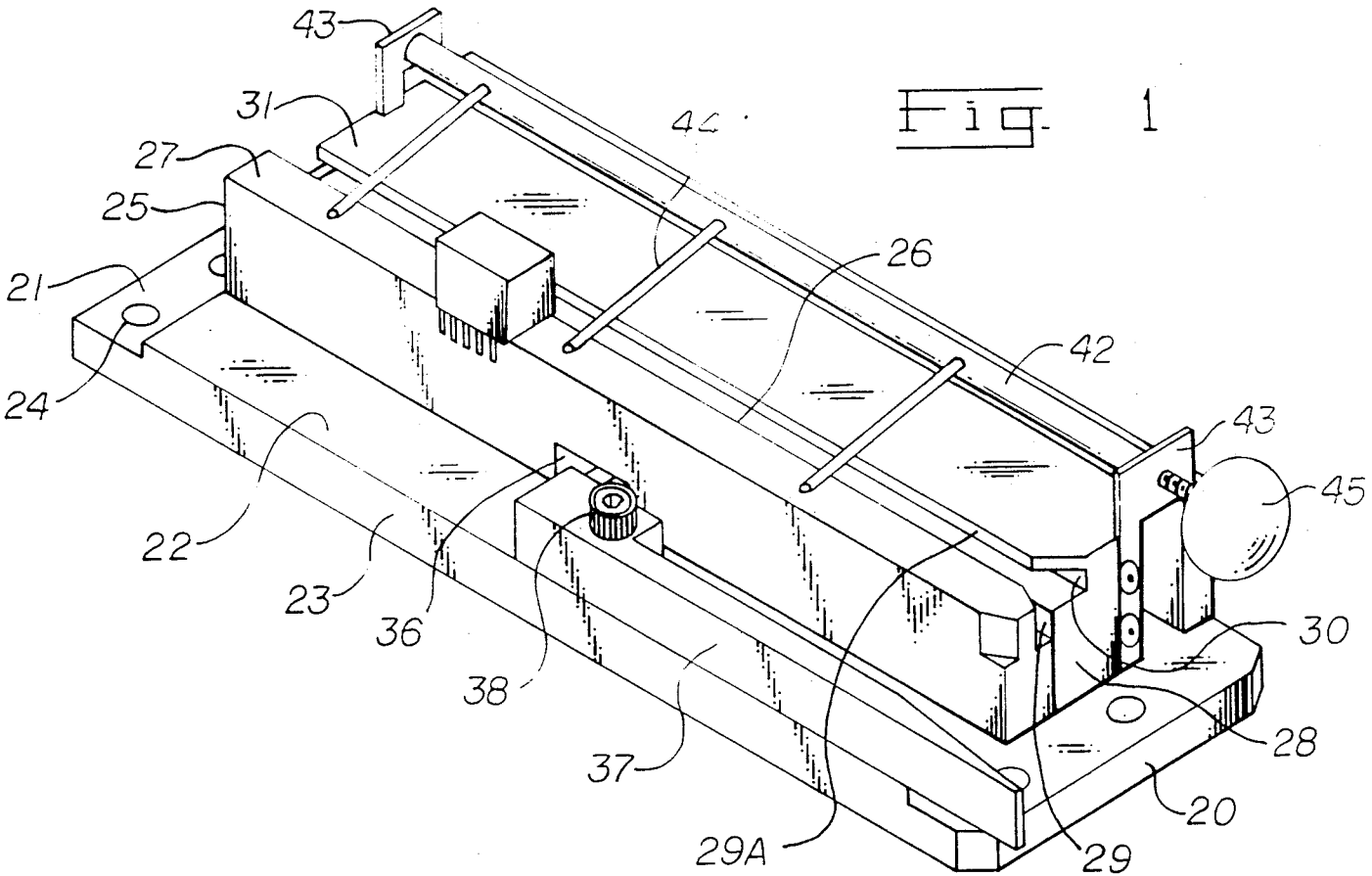
FIG. 1 is a perspective view of a holder of the present invention with the optional DIP locator assembly in the activated position.

Referring now to FIG. 1 of the accompanying drawings, the present holder includes a substantially rectangular base 20 having two major and two minor sides, a first planar surface 21 and a smaller second planar surface 22 that is rectangular in shape and elevated with respect to the first surface. The second surface is centrally positioned along one side 23 of the first surface and bounded on the three remaining sides by the first surface. Side 23 is one of the two major sides of base 20. The one remaining major and the two minor sides of base 20 are defined by the remaining three sides of surface 21.

The sections of surface 21 adjacent to the two minor sides of base 20 optionally contain one or more mounting holes 24 whereby the holder can be secured to a suitable support such as a table or work station.

Surface 22 extends from side 23 inward to a fixed jaw 25 of substantially rectangular configuration that extends the entire length of surface 22 and is parallel with respect to side 23. The fixed jaw comprises a vertical surface 26 that is substantially planar and perpendicular with respect to surfaces 21 and 22. The fixed jaw also includes an upper surface 27 that is substantially planar, shares a common side with surface 26 and is substantially parallel with respect to surfaces 21 and 22.

A movable jaw 28 of substantially rectangular configuration is positioned on surface 21. One surface, 29, of this jaw faces surface 26 of the fixed jaw. The lengths of surfaces 26 and 29 are substantially equal, and the height of the movable jaw is greater than the height of the fixed jaw.

Figure 2:
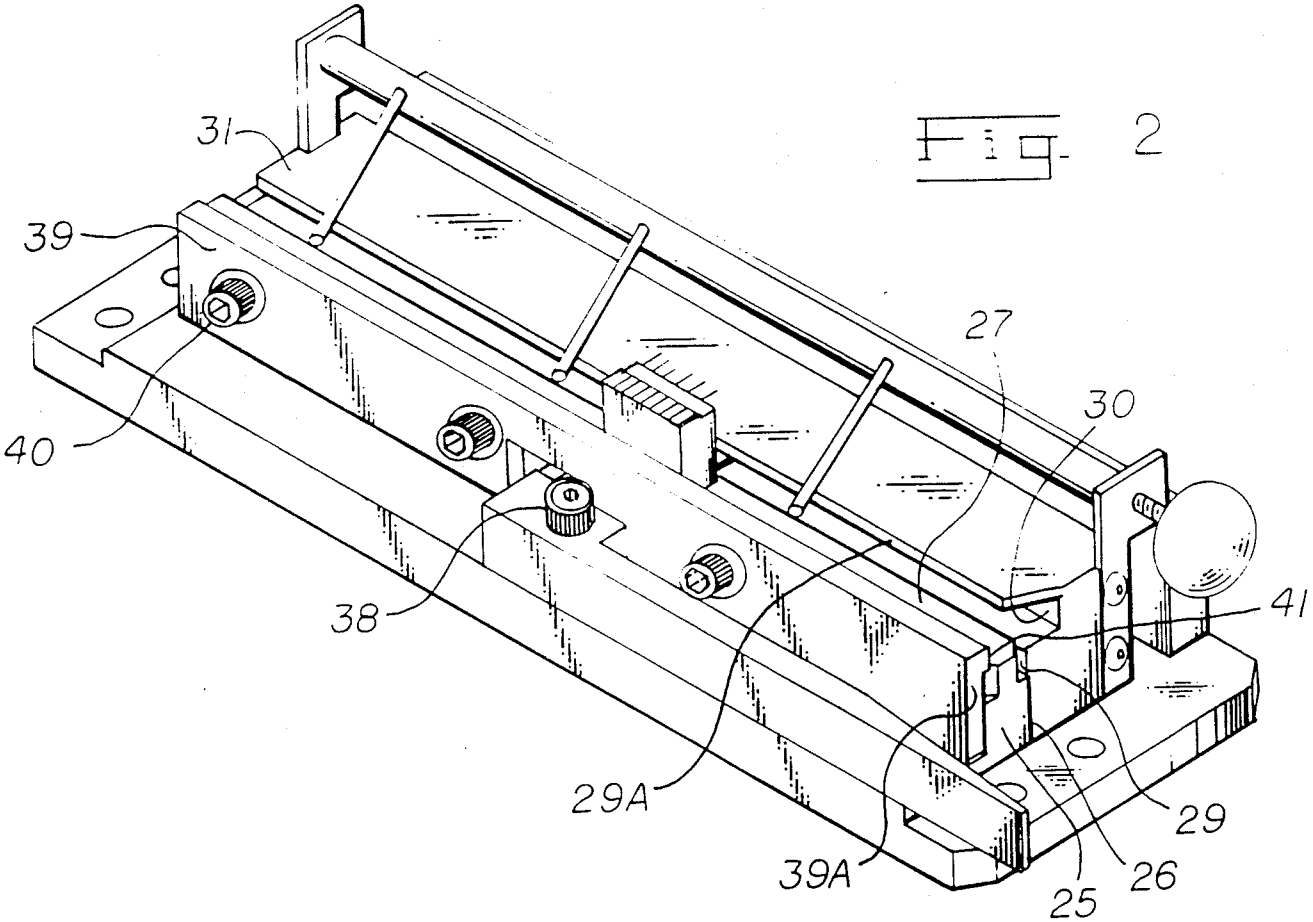
FIG. 2 is a perspective view of a holder of the present invention having a retaining plate secured to the fixed jaw of the holder and the DIP locator assembly in the activated position.

A groove 30 in the vertical surface of the movable jaw extends the entire length of the jaw, comprises upper and lower horizontal surfaces and a vertical surface. The groove separates vertical surfaces 29 and 29A. The plane defined by the lower horizontal surface of this groove is slightly below the plane defined by surface 27 of the fixed jaw. The relative locations of groove 30 and the upper surface 27 of the fixed jaw, and the dimensions of the groove are selected to permit at least one row of electrical connectors of a DIP or other electronic device to extend into the groove and any remaining rows of connectors to extend above surface 31 of the movable jaw when the DIP is positioned on the upper surface of the fixed jaw as shown in FIG. 2 with its two rows of connectors directed toward vertical surface 28 of the movable jaw.

Figure 3:
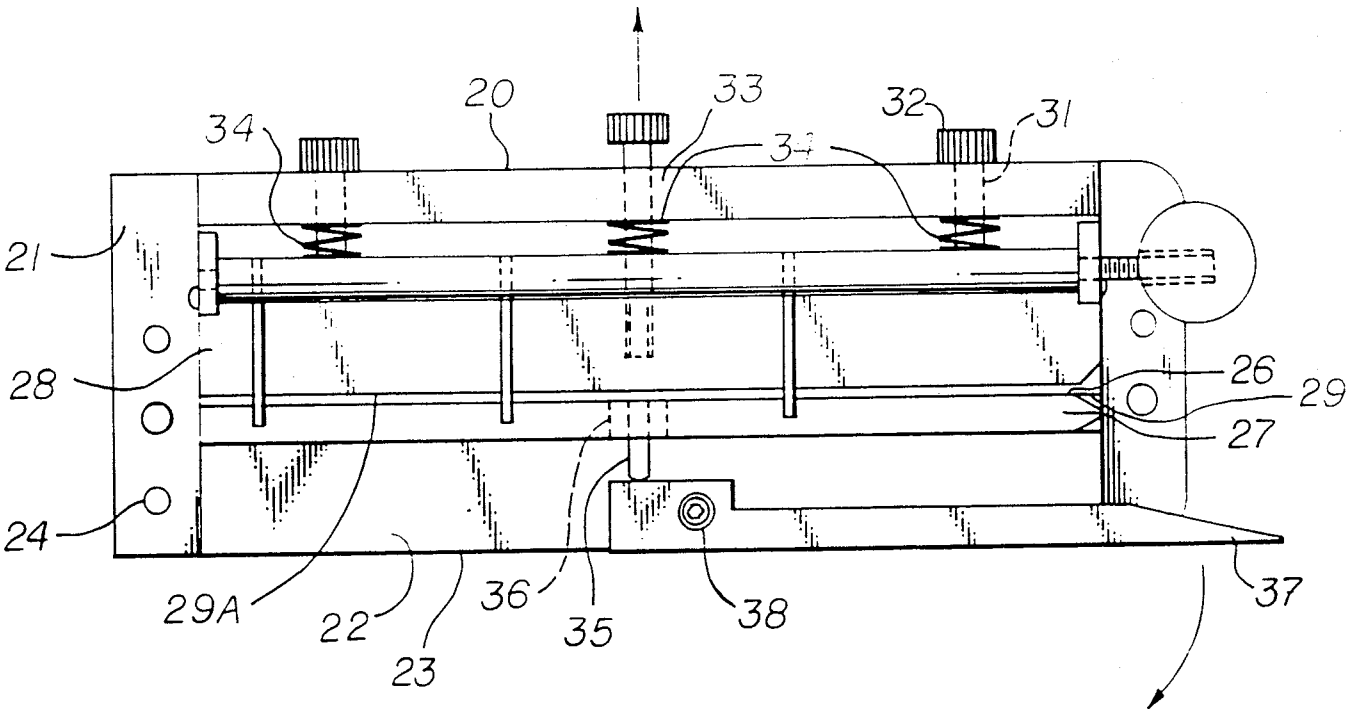
FIG. 3 is a plan view of the holder of FIG. 1.

Referring now to FIG. 3, the movable jaw is positioned on surface 21 by means of three bolts 31 having heads 32 that rest against the outer surface of wall 33. This wall extends along the major side of base 20 that is opposite from side 23. The wall and the movable and fixed jaws are centrally positioned with respect to the longitudinal dimension of rectangular base 20.

The shanks of bolts 31 pass through passages in wall 33 that are larger in diameter than the shanks of the bolts. The bolts are secured into the surface of movable jaw 28 that is opposite to surface 29. Three compressed coil springs 34 located on the shanks of bolts 31 extend from the inner surface of wall 33 to the surface of the movable jaw that is opposite from surface 29. The force exerted by the compressed springs against the movable jaw acts to urge surface 29 of this jaw toward contact with surface 25 of the fixed jaw.

The mechanism by which the distance between surfaces 26 and 29 is increased comprises rod 35, which rests against surface 29 of the movable jaw at a location adjacent to surface 22 of the base. The rod traverses passage 36 in the fixed jaw and terminates adjacent to one end of a lever 37 that is rotatably mounted on base 20 by means of a bolt 38 that serves as the pivot point for the lever. Application of a force to lever 37 at the end opposite from rod 35 and in a direction indicated by the arrow in FIG. 3 counteracts the force exerted by springs 34 and urges the movable jaw away from the fixed jaw.

With respect to the operation of the embodiment of the holder shown in FIGS. 1 and 3, the movable jaw is urged away from the fixed jaw by exerting a force on lever 37 as described in the preceding paragraph, thereby creating a gap between surfaces 26 and 29 of sufficient width to allow placement of a DIP in the position depicted in FIG. 1, with one row of electrical connectors on either side of fixed jaw surface 27. When the force on the lever is released the movable jaw moves toward the fixed jaw under the force exerted by springs 34, thereby grasping one row of connectors on the DIP between opposing surfaces 26 and 29. Surface 29A, located above groove 30 contacts the side of the DIP adjacent to the side bearing the electrical connectors and stabilizes the position of the DIP in the holder. In this embodiment of the present holder sections of surfaces 26 and 29 constitute the grasping area whereby the DIP or other electronic device is secured in position when placed on surface 27. One end of surface 27 is preferably tapered to facilitate sliding a DIP onto surface 27.

A second embodiment of the present holder, shown in FIG. 2, allows one or more DIP's to be secured along their longitudinal axis with the two rows of electrical connectors on the DIP substantially parallel with respect to the base of the holder. This embodiment of the holder contains a retaining plate 39 secured to a surface of the fixed jaw, 25, that is opposite from and substantially parallel to surface 26. The plate is secured to the fixed jaw by means of three bolts 40 and extends about 5 mm. above surface 27. A ridge, 39A, along the upper edge of plate 39 overlaps surface 27 for a distance of about 1 mm. and includes a vertical surface 41 that faces and is substantially parallel to surface 29 of the movable jaw. When surfaces 26 and 29 are in contact the distance between surfaces 29 and 41 is less than the thickness of the DIP, measured from the surface containing the electrical connectors.

In this embodiment of the present holder the DIP's are positioned as shown in FIG. 2 with the side adjacent to the one bearing the two rows of connectors resting on surface 27, the lower row of connectors accommodated within groove 30 and the upper row of connectors above and substantially parallel to the upper surface 31 of the movable jaw. Opposing surfaces 41 and 29A define a grasping area that immobilizes the DIP's. It should be understood that when no devices are present on the holder the distance between surfaces 29A and 41 is less than the thickness of the device that will be placed on surface 27, thereby allowing the DIP to be firmly grasped and immobilized between these two opposing surfaces.

The present holder is optionally equipped with a locator assembly that can be used to accurately position the DIP's during an automated treatment or inspection operation. Such as assembly is particularly useful when the devices are positioned on the holder by a human operator rather than by mechanical means. Referring again to FIG. 1, the locator assembly comprises a shaft 42 that is rotatably mounted between a set of two brackets 43 secured to each end of the movable jaw. Two or more locating pins 44 project radially from the shaft in substantially coplanar alignment. The aligning assembly is placed in the active position by rotating shaft 42 by means of knob 45 in a counterclockwise direction until pins 44 rest against the surface 31 of the movable jaw and project over a portion of surface 27 as shown in FIGS. 1 and 3. The pins serve as location guides for positioning DIP's along surface 27 of the fixed jaw.

The present holder can be fabricated from any material capable of withstanding the force required to immobilize the DIP's or other devices placed on the holder. Metals are preferred, with stainless steel being particularly preferred based on its durability and resistance to corrosion.

That which is claimed is:

1. A holder for accurately positioning and immobilizing at least one electronic device having two parallel rows of electrical connectors, said holder comprising:

(1) a base having a substantially planar surface, (2) a fixed jaw secured to said surface, (3) a movable jaw positioned on said surface and having a first substantially planar vertical surface that faces and is parallel to a second vertical surface located on said fixed jaw, (4) a grasping area defined by a portion of said first and second vertical surfaces, whereby said device positioned on a substantially horizontal surface adjoining said second vertical surface is immobilized, (5) resilient means associated with said movable jaw for urging said movable jaw into contact with said fixed jaw with sufficient force to immobilize said device within the grasping area, and (6) means for allowing removal of devices from said grasping area, comprising means for exerting a force on the movable jaw in a direction substantially opposite to the force urging the movable jaw into contact with the fixed jaw, thereby increasing the distance between the fixed and movable jaws sufficiently to remove the immobilizing force acting on said device.

2. A holder according to claim 1 where the fixed and movable jaws are of substantially rectangular configuration, the movable jaw contains an upper surface adjoining said first vertical surface and substantially parallel with respect to the surface of said base.

3. A holder according to claim 1 where the device positioned on said horizontal surface is oriented such that one row of connectors is secured within said grasping area.

4. A holder according to claim 1 where said holder includes a locating apparatus comprising a shaft that is rotatably secured on said holder and has a plurality of locating pins extending radially from said shaft and exhibiting a collinear alignment, said apparatus having a locating position wherein said pins rest on said upper surface and extend over at least a portion of said horizontal surface.

5. A holder according to claim 4 where said locating apparatus is secured to said movable jaw.

6. A holder according to claim 2 where said first vertical surface contains a groove that is both parallel and adjacent to but spaced from said upper surface, said second vertical surface projects from said horizontal surface in a direction away from and substantially perpendicular to the surface of said base, and said portion of said first vertical surface defining said grasping area includes the portion of said first vertical surface bounded by said groove and said upper surface; the location, depth and width of said groove cooperating to accommodate at least the lower row of electrical connectors of said device when immobilized within said grasping area in a manner such that the surface of the device bearing said connectors is oriented toward said movable jaw.

* * * * *

UNITED STATES PATENT AND TRADEMARK OFFICE

CERTIFICATE OF CORRECTION

PATENT NO. : 4,934,677

DATED : June 19, 1990

INVENTOR(S) : Timothy W. Mitin and James C. Sell, Jr.

It is certified that error appears in the above-identified patent and that said Letters Patent is hereby corrected as shown below:

On the cover sheet, under section [19], "Mitlin" should be --Mitin--.

On the cover sheet, at section 75 Inventors:, please change the last name of the first listed inventor from "Mitlin" to --Mitin--.

Signed and Sealed this

Twenty-ninth Day of October, 1991

*Attest:*

HARRY F. MANBECK, JR.

*Attesting Officer*

*Commissioner of Patents and Trademarks*